US005577337A

United States Patent [19]

Lin

[11] Patent Number: 5,577,337

[45] Date of Patent: Nov. 26, 1996

[54] POSITIONING ASSEMBLY FOR SHELF PLACARDS AND SEPARATORS

[76] Inventor: Hsu K. Lin, No. 37, Lane 58, Kuangfu South Rd., Taipei, Taiwan

[21] Appl. No.: 496,298

[22] Filed: Jun. 29, 1995

[51] Int. Cl.[6] ..... A47F 5/00

[52] U.S. Cl. ..... 40/642; 211/94

[58] Field of Search ..... 40/642; 211/94; 312/234.1, 193, 117, 119, 122

[56] References Cited

U.S. PATENT DOCUMENTS 4,896,779 1/1990 Jureckson ..... 211/94 X

*Primary Examiner*—Kenneth J. Dorner
*Assistant Examiner*—Cassandra Davis

[57] ABSTRACT

A positioning assembly comprieses a transverse plate, a plurality of separators, a longitudinal blocking frame and a placard. The transverse plate has at least one longitudinal flap end. The frame has a transverse groove to receive a positioning panel which has two laminae to form a gap. A separator is received between two laminal. A longitudinal slot is formed in the flap end to receive the frame and the hook-shaped edge of a placard holder together.

2 Claims, 4 Drawing Sheets

POSITIONING ASSEMBLY FOR SHELF PLACARDS AND SEPARATORS

BACKGROUND OF THIS INVENTION

This invention relates to a shelf positioning assembly, and more particularly a positioning assembly for shelf placards and separators.

The conventional goods shelves have several types. In general, most goods shelves need nails and screws to support the placards and separators on the shelves. The nails and screws are easily rusty and show ugly appearance on the surface of the shelves. Some stores avoid the application of nails and screws for the placards and separators. They use reverse T-shaped boards as conventional separators. However, the conventional separators are easily fallen down or easily removed. Therefore, the conventional separators are not practical for goods shelves.

Furthermore, the poster, marked price, goods labels and placards are tagged or adhered on the shelf. It is difficult to clean the remains of labels and placards after they are removed or torn off. The marked price, goods labels and placards are often changed in the department stores, so the above-problems are always cumbersome.

SUMMARY OF THE INVENTION

The main object of this invention is to provide a positioning assembly for positioning shelf separators without nails or screws.

Another object of this invention is to provide a positioning assembly which can easily remove shelf separators without removing nails or screws.

A further object of this invention is to provide a positioning assembly for positioning shelf placards without adhesion.

A further object of this invention is to provide a positioning assembly which can easily remove shelf placards without leaving the remains of placards.

DESCRIPTION OF THE PREFERRED EMBODIMENT

Figure 1:
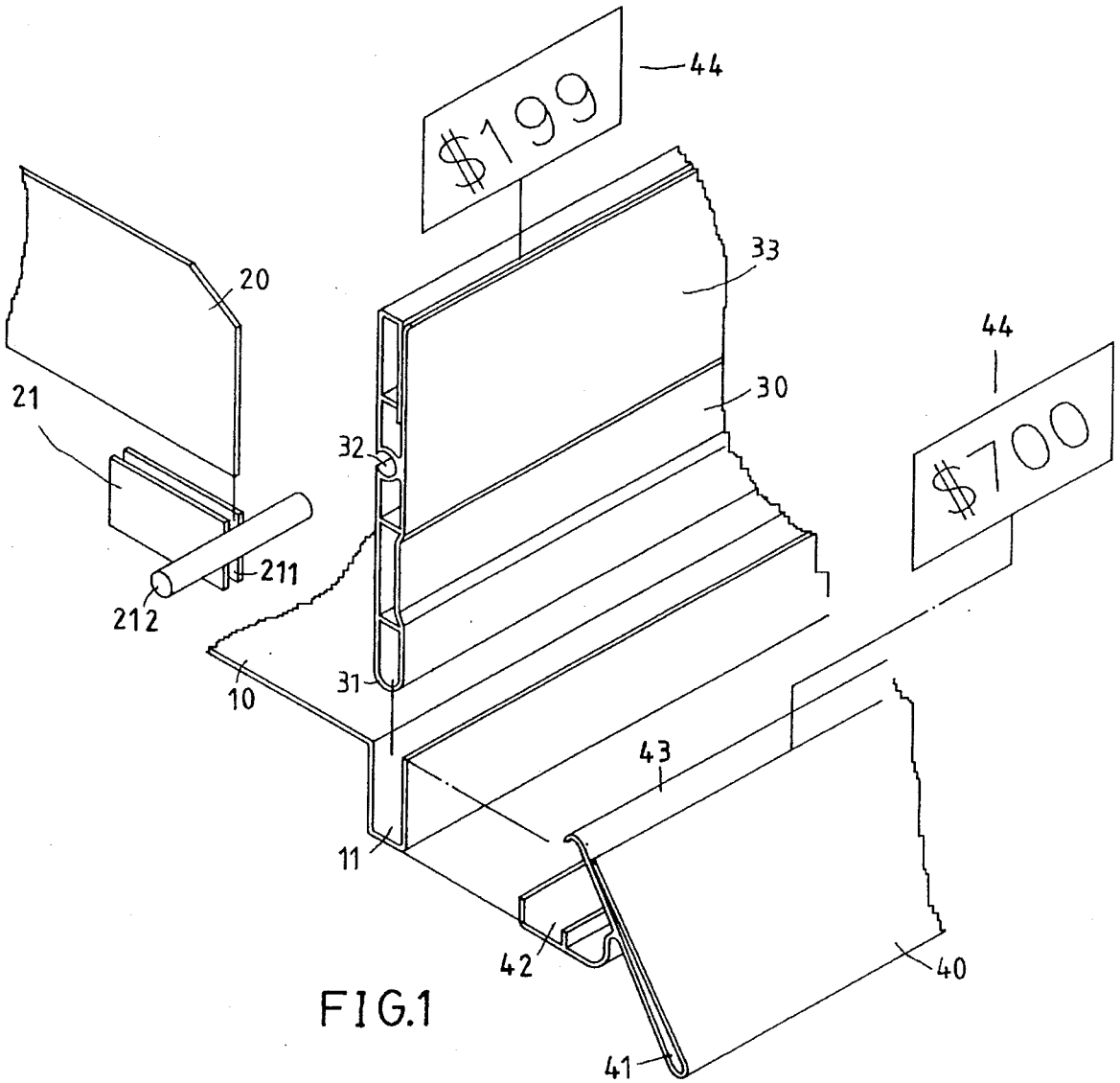
FIG. 1 is an exploded view of a positioning assembly for shelf placards and separators of a preferred embodiment in accordance with the invention.
Figure 2:
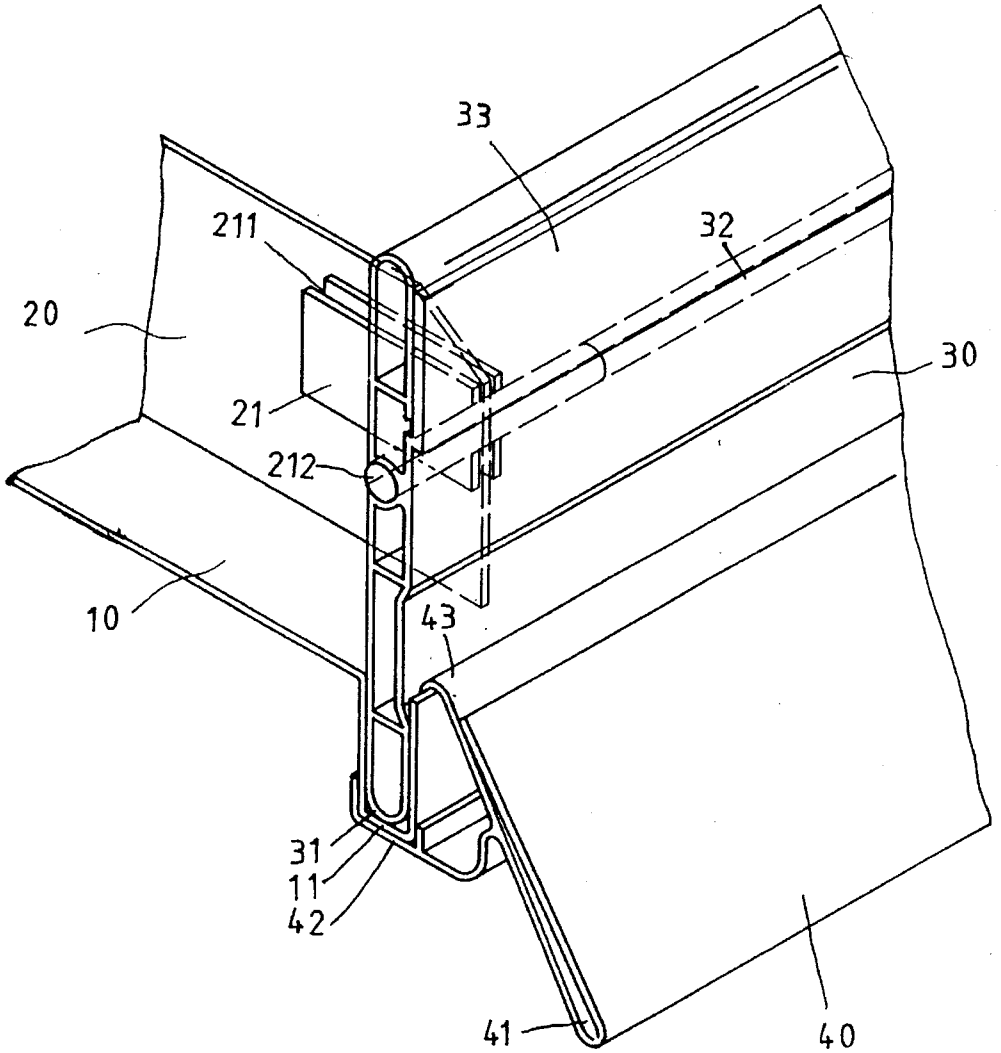
FIG. 2 is an assembly perspective view of FIG. 1.

FIGS. 1 and 2 show the first preferred embodiment of this invention. A positioning assembly for shelf placards and has a transverse plate 10, a plurality of separators 20, a longitudinal blocking frame 30 and a placard holder 40. One end of the transverse plate 10 becomes a longitudinal flap 11 as the leg to support the transverse plate 10. The transverse plate 10 can be supported by a plurality of supporters which are disposed beneath the transverse plate 10 also. The placard holder 40 has a transparent surface, a label socket 41 to receive a label 44. The upper edge of the placard holder 40 is a hook-shaped edge 43. A guidance board 42 which has a transverse slot to receive the flap 11 connects the back portion of the placard holder 40 resiliently in order to support the placard holder 40 at a predetermined angle. The flap 11 is inserted into the slot of the guidance board 42. The hook-shaped edge 43 of the placard holder 40 is resilent in order to be positioned between a blocking frame 30 and the flap 11. The flap 11 has a longitudinal slot to receive the inserting end 31 of the blocking frame 30. An upper transparent placard 33 is integral with an upper portion of the blocking frame 30. A transverse circular groove 32 is formed at the middle portion of the frame 30. A positioning panel 21 has two parallel laminae 211 connecting to a transverse rod 212. A plurality of positioning panels 21 are inserted into the circular groove 32 via the transverse rods 212 one by one. The two laminae 211 form a gap to receive a separator 20. The transverse rods 212 can be easily moved to any predetermined position. Referring to FIG. 2, the transverse rods 212 are positioned in the predetermined place and then each of the separators 20 is received between two parallel laminae 211.

Figure 3:
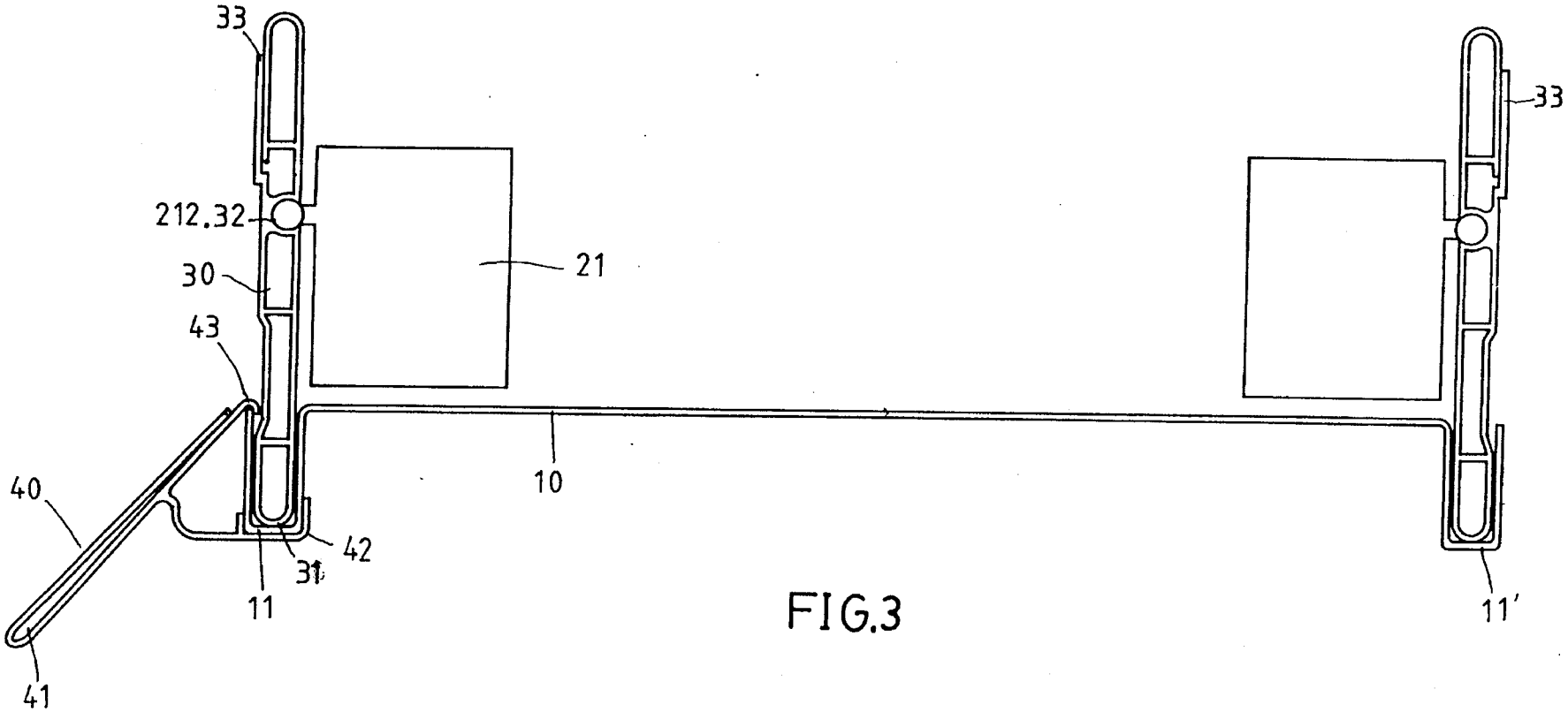
FIG. 3 is a plan view of a positioning assembly for shelf placards and separators of another preferred embodiment in accordance with the invention.
Figure 4:
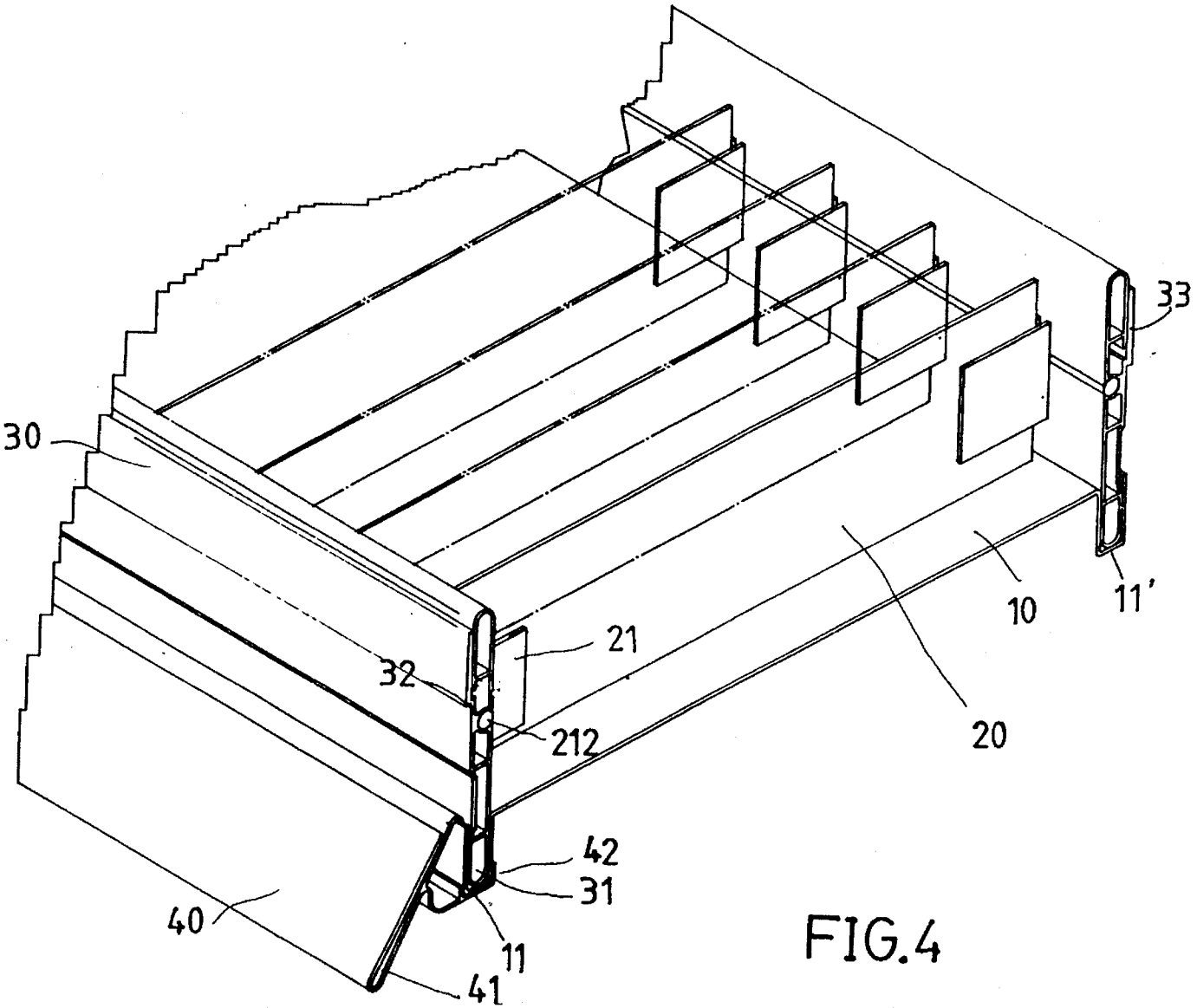
FIG. 4 is an assembly perspective view of FIG 3.

The second preferred embodiment of this invention is shown in FIGS. 3 and 4. The transverse plate 10 has two corresponding flaps 11 and 11' at two corresponding ends. The front end of the plate 10 and the corresponding elements are similar to the first preferred embodiment. However, the rear end of the plate 10 eliminates the placard 40 at the frond end of the plate 10.

This invention provides the following advantages: (1) The separators 20 are positioned fixedly without sway, (2) The positioning panel 21 can be moved to any predetermined area transversely, (3) The placard 40 can be changed easily. (4) The quality and image of the positioning assembly for shelf placards and separators are excellent as a whole assembly. The whole assembly does not apply any nail nor screw. The placard does not apply any paste nor adhesives so that the whole appearance is very neat. (5) The sizes of labels can be varied so that the poster, marked price and other notices are distinguished clearly.

What is claimed is:

1. A positioning assembly comprising:

a transverse plate with a longitudinal flap end;

a longitudinal blocking frame with a transverse groove at a middle portion of said blocking frame;

at least a positioning panel which has two parallel laminae connecting to a transverse rod being inserted into said transverse groove of said blocking frame via said rod;

a separator being received between said parallel laminae;

an upper placard being integral with an upper portion of said blocking frame;

a lower placard holder having a hook-shaped edge;

a longitudinal slot being formed in said flap end; said blocking frame being inserted into said longitudinal slot; and said hook-shaped edge of said placard holder being positioned between said blocking frame and said flap end.

2. A positioning assembly as claimed in claim 1, wherein said transverse plate has two longitudinal flap ends to receive two blocking frames, respectively.

* * * * *